US007390113B2

(12) United States Patent
Liou

(10) Patent No.: US 7,390,113 B2
(45) Date of Patent: Jun. 24, 2008

(54) PROJECTOR-TYPE VEHICLE HEADLAMP SYSTEM

(75) Inventor: Yuan-Chang Liou, Nantou (TW)

(73) Assignee: Chungchou Institute of Technology, Changhwa County (TW)

( * ) Notice: Subject to any disclaimer, the term of this patent is extended or adjusted under 35 U.S.C. 154(b) by 149 days.

(21) Appl. No.: 11/407,200

(22) Filed: Apr. 20, 2006

(65) Prior Publication Data

US 2007/0247863 A1 Oct. 25, 2007

(51) Int. Cl.
*F21V 1/00* (2006.01)

(52) U.S. Cl. ..... 362/509; 362/517; 362/538

(58) Field of Classification Search ..... 362/509, 362/517–518, 538

See application file for complete search history.

(56) References Cited

U.S. PATENT DOCUMENTS 5,113,321 A * 5/1992 Suzuki ..... 362/538

FOREIGN PATENT DOCUMENTS

JP 2005302718 * 10/2005

* cited by examiner

*Primary Examiner*—Ali Alavi
(74) *Attorney, Agent, or Firm*—Muncy, Geissler, Olds & Lowe, PLLC

(57) ABSTRACT

A projector-type vehicle lamp comprises a reflector, a light source and a lens. The reflector, which makes the light source produce a desired light pattern without using any shade interposed between the reflector and the lens, has a free curved surface and is designed with a multi-ellipsoid equation. In addition, the projector-type vehicle headlamp system also produces an optimum utilizing rate with its high gradient of illumination.

7 Claims, 9 Drawing Sheets

PROJECTOR-TYPE VEHICLE HEADLAMP SYSTEM

BACKGROUND

1. Field of Invention

The present invention relates more particularly to a vehicle headlamp system, and more generally to a projector-type vehicle headlamp system that does not use a shade interposed between a light source and a lens.

2. Description of Related Art

With developments of optical systems relevant to vehicle headlamp systems, many headlamp systems have been designed, such as the multi reflector (MR) vehicle headlamp system, the free-form reflector (FR) vehicle headlamp system, and the poly-ellipsoid system (PES) vehicle headlamp system. The PES vehicle headlamp system is a projector-type headlamp system that has more advantages than the other systems.

Firstly, the headlamp height on the PES vehicle headlamp system may be easily adjusted to adapt to the road conditions. Easy headlamp height adjustment increases overall driving safety.

Secondly, the headlamp light pattern cut-off line of the PES vehicle headlamp system is clearer than the cut-off lines of the other vehicle headlamp systems. The passing beam generated is therefore more comfortable and safer to the drivers who come from the front.

FIG. 1 shows the testing zones of a light pattern for a passing light beam from a conventional vehicle headlamp system that conforms to the passing-beam requirements of the ECE (Economic Commission for Europe) regulations. In FIG. 1, character "v" indicates a vertical plane and character "h" indicates a horizontal plane. The brightest testing point (75R) of the bright testing zone is adjacent to the dark testing zone (such as Zone III). The required illumination of the brightest testing point (75R) is equal to or more than 12 lux, and the required illumination of the dark testing zone (such as Zone III) is equal to or less than 0.7 lux. The required illumination of the light pattern between the bright and dark testing zones changes sharply that makes it difficult to design a vehicle headlamp with a desirable light pattern. Moreover, the required illumination of a light pattern needs to produce a clear cut-off line to divide the bright and dark testing zones.

FIG. 2-FIG. 4 illustrate a conventional PES vehicle headlamp system 100, comprising an ellipsoidal reflector 110, a light source (a bulb or a filament) 120, a lens 130 and a shade 140. The ellipsoidal reflector 110 focuses the light rays emitted from the light source 120 located at the first focal point 111 of the ellipsoidal reflector 110 into a second focal point 112. The lens 130 then moves to make sure that its focal point 131 (The focal point 131, which is a third focal point 131 of the conventional PES vehicle headlamp system 100, is one focal point of the lens 130.) overlaps the second focal point 112 of the ellipsoidal reflector 110. Thereafter, the shade 140 is interposed between the ellipsoidal reflector 110 and the lens 130 to block some of the light rays emitted from the ellipsoidal reflector 110 and the light source 120 in order to produce a desirable light pattern with a clear cut-off line.

Although the shade 140 enables the conventional PES vehicle headlamp system 100 to generate a desirable light pattern by blocking some of the light rays, it lowers the utility rate of the light rays emitted from the light source. Generally, about half of the light rays emitted from the light source will be blocked by the shade 140, reducing the light source lighting efficiency by half.

FIG. 5A shows an image of the light patterns for lighting distribution zones of a conventional PES vehicle headlamp system 100 that does not use a shade 140. The lighting distribution zones are divided into six lighting distribution zones. These six lighting distribution zones are lighting distribution zone i, zone ii, zone iii, zone iv, zone v, and zone vi. FIG. 5B shows the six reflecting zones on an ellipsoidal reflector 110 that separately corresponded to the six lighting distribution zones. These six reflecting zones are reflecting zone i', zone ii', zone iii', zone iv', zone v' and zone vi', which respectively corresponds to the lighting distribution zone i, zone ii, zone iii, zone iv, zone v and zone vi.

FIG. 6 is an lighting distribution of the glare light produced in lighting distribution zone vi of a conventional PES vehicle headlamp system 100 that does not use a shade 140, and in which reflecting zone vi' of the reflector ellipsoidal 110 totally redirects the light rays emitted from the light source 120 to lighting distribution zone vi. Because the light source 120 is positioned at the first focal point 111, the light rays emitted from the light source 120 via the reflecting zone vi' form lighting distribution zone vi, which is mostly spread above the Y=0 horizontal line in FIG. 6 indicating that serious glare light is generated. The glare light compromises the safety of passing drivers. Therefore, the shade 140, which is used to prevent the occurrence of glare light, is one of the essential elements of a conventional PES vehicle headlamp system 100 but the shade 140 reduces the illuminating utility rate of the light source 120.

Additionally, in a conventional PES vehicle headlamp system 100 that does not use a shade 140, the lighting distribution spread is lowered below the Y=0 horizontal line (a desirable light pattern) by combining the ellipsoidal reflector 110 with two or more reflectors that have reflecting surfaces usually designed with an ellipsoid equation to ensure that the focal point of each reflector is located at the same point. Typically, the ellipsoidal reflector 110 of the conventional PES vehicle headlamp system 100 that does not use a shade 140 is composed of plural reflectors that generate the desirable light pattern. But the junctions (crevices) of the plural reflectors usually form one or more steps, which are the junction (crevice) of two or more different level surfaces of the plural of reflectors, also cause glare light.

For the foregoing reasons, there is a need to improve the illuminating utility rate of the light source without compromising the light pattern of the vehicle headlamp.

SUMMARY

The present invention is directed to a projector-type vehicle headlamp that removes the glare lights and increases the illuminating utility rate of the vehicle headlamp light source without using any shades. The vehicle headlamp system of the present invention comprises a reflector, a light source and a lens.

It is an objective of the present invention to provide a projector-type vehicle headlamp with a reflector that has a reflecting surface designed with a multi-ellipsoid equation.

In one embodiment of the present invention, the multi-ellipsoid equation is used to design a reflector with a totally continuous free-curved reflecting surface and one or more first focal points. Moreover, the position of each first focal point may be changed when the major axis length of the ellipse and the minor axis length of the ellipse are changed. Namely, the position of the first focal point of the reflecting surface shaped as an ellipsoid can be specified by changing the lengths of the axes of an ellipsoid on a reflecting surface. Thus, the lighting distribution image of the light source via the reflecting surface is controllable when the desired requirements are specified. Hence, a shade no longer needs to be installed in projector-type vehicle headlamp systems to form a desirable lighting distribution.

It is another objective of the present invention to provide a vehicle headlamp with a simpler structure than the conventional vehicle headlamp system by eliminating the shade, which blocks the light rays emitted directly or indirectly from the light source.

In another embodiment of a projector-type vehicle headlamp system of the present invention, the projector-type vehicle headlamp system without a shade reduces the number of manufacturing assembly processes needed to manufacture the vehicle headlamp system and therefore lowers the manufacturing cost.

It is still another objective of the present invention to provide a vehicle headlamp system that has a reflector with a totally free-curved reflecting surface designed with a multi-ellipsoid equation.

In still another embodiment of the present invention, a reflecting surface with a continuous surface having no step, where the step is the junction (crevice) between two different reflecting surfaces. Besides, the projector-type headlamp is much easier to manufacture when the reflector has a single reflecting surface. Therefore, there is no need to combine two or more reflecting surfaces in the reflector to generate a desirable light pattern for a projector-type vehicle headlamp system.

It is yet another objective of the present invention to provide a projector-type vehicle headlamp system with a better illumination utility rate than conventional vehicle headlamp systems.

In yet another embodiment of a projector-type vehicle headlamp system of the present invention, the projector-type vehicle headlamp system without a shade has a higher illuminating utility rate with no shade interposed between the light source and the lens. The position of each focal point for each reflecting zone on a reflecting surface may overlap the lighting distribution zones where the reflecting surface has one or more focal points. Thus, by overlapping the lighting distribution zones and the reflecting zone the illuminating utility rate of the projector-type vehicle headlamp system is greatly increased.

Moreover, in yet another embodiment of the present invention, changing the first focal point position of each reflecting zone widens the lighting distribution image width.

It is to be understood that both the foregoing general description and the following detailed description are examples, and are intended to provide further explanation of the invention as claimed.

BRIEF DESCRIPTION OF THE DRAWINGS

The accompanying drawings are included to provide further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
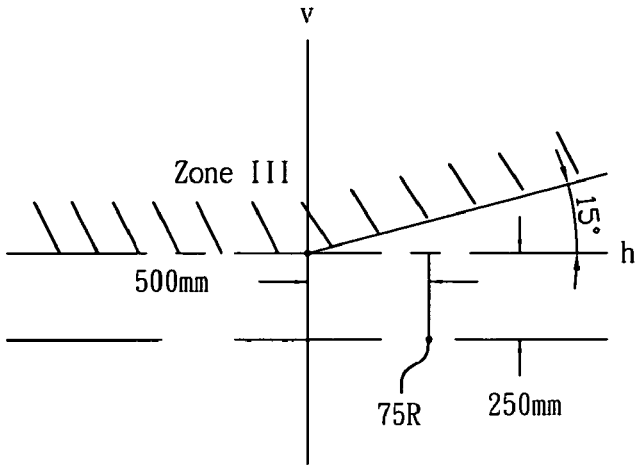
Fig. 1 (Prior art)
FIG. 1 shows the testing zones of a light pattern of a passing beam for a conventional vehicle headlamp system.

Reference will now be made in detail to the present preferred embodiments of the invention, examples of which are illustrated in the accompanying drawings. Wherever possible, the same reference numbers are used in the drawings and the description to refer to the same or like parts.

Figure 7:
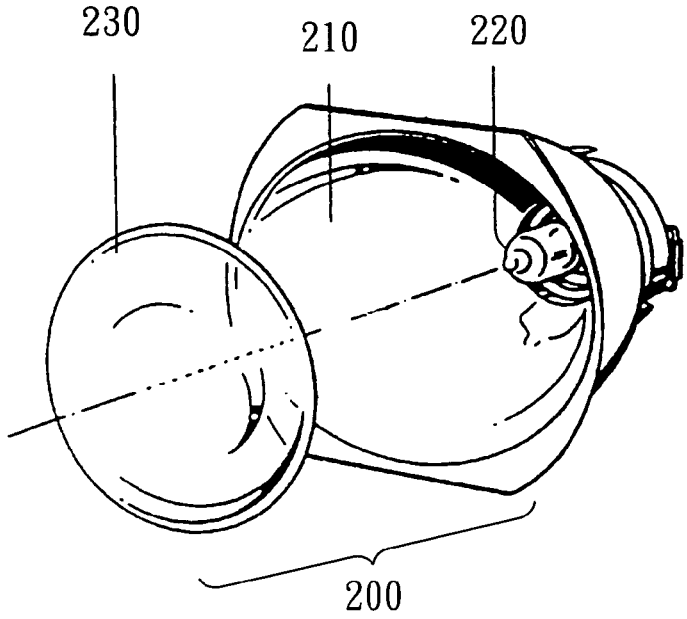
FIG. 7 shows a preferred embodiment of a vehicle headlamp system of the present invention.

FIG. 7 shows a preferred embodiment of a vehicle headlamp system 100 of the present invention, which comprises a multi-ellipsoid reflector 210, a filament 220, and a lens 230. The multi-ellipsoid reflector 210 is a reflector designed with a multi-ellipsoid equation (1). The filament 220 is a light source. A lens 230 refracts the lights emitted from the filament 220 directly and/or indirectly.

Figure 8:
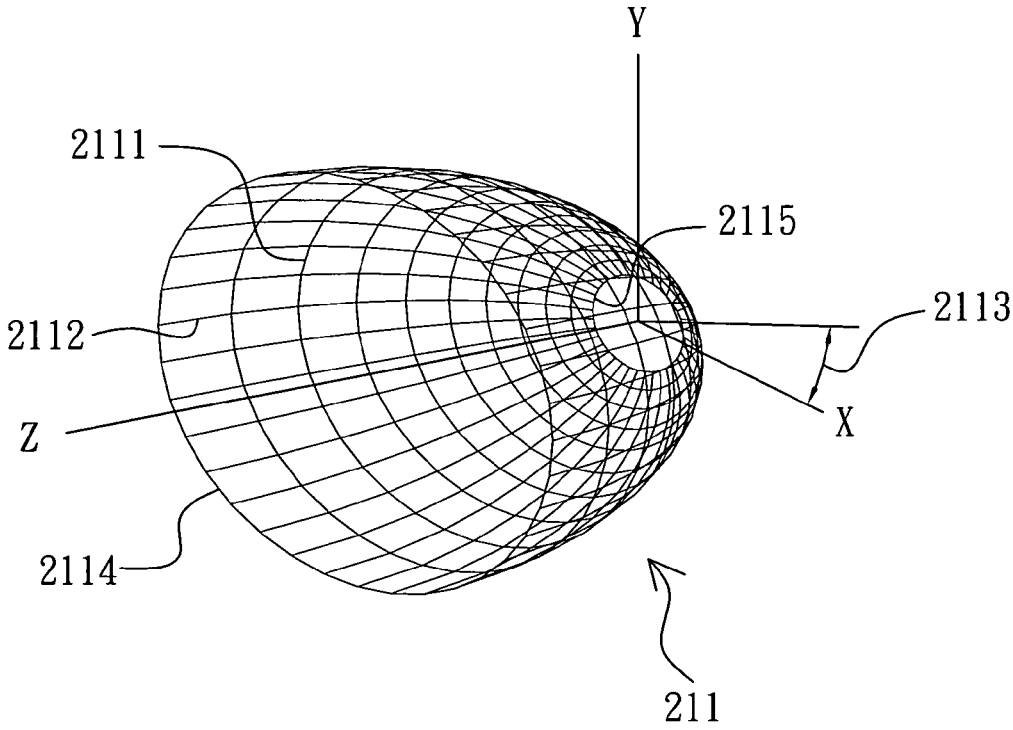
FIG. 8 is a geometric diagram of a reflecting surface of a reflector in three-dimensional space.

FIG. 8 illustrates a geometric diagram of a multi-axes reflecting surface 211 of a multi-ellipsoid reflector 210 in one preferred embodiment of the present invention. The multi-axes reflecting surface 211 designed and formed with a multi-ellipsoid equation (1) has a multi-axes reflecting surface, with at least one latitudinal ellipse 2111 and at least one longitudinal ellipse 2112. Where a latitudinal ellipse 2111 is on a cross-section plane, which is perpendicular to an optical axis. And a longitudinal ellipse 2112 is on a cross-section plane, which is parallel to an optical axis.

Referring to FIG. 8 again, in a Cartesian coordinate system, the character "X" indicates a horizontal axis, the character "Y" indicates a vertical axis, and the character "Z" indicates an optical axis that is perpendicular to both the horizontal axis and vertical axis. An angle (θ) 2113 is an included angle that is formed by a projecting a point onto the xy-plane and connecting the projected point to the point of origin on the xy-plane. The angle formed between the line connecting the point of origin to the projected point on the xy-plane and the x-axis is the included angle. In one embodiment of a projector-type vehicle headlamp lamp of the present invention, when the angle (θ) 2113 is zero degrees, the projected point is located on the x-axis passing the point of origin on the right side. In another embodiment of the present invention, when the angle (θ) 2113 equals ninety degrees, the point projected on the xy-plane is located on the y-axis above the point of origin. In addition, in FIG. 8, the latitudinal cross-sectional planes are cross-sectional planes of an optical axis of the multi-ellipsoid reflector 210 and are shown as gridded latitudinal circles of the reflecting surface 211 in FIG. 8. Longitudinal cross-sectional planes are sectional planes parallel to the optical axis of the multi-ellipsoid reflector 210 and are shown as gridded longitudinal circles of the reflecting surface 211 in FIG. 8.

The multi-ellipsoid reflector 210 is designed with the multi-ellipsoid equation (1). The multi-ellipsoid equation (1) that enables the multi-ellipsoid reflector 210 to control the image of the lighting distributions is described below:

Equation (1):

$$\frac{X^2+Y^2}{b^2(\theta,Z)}+\frac{(Z-a(\theta,z)^2)}{a^2(\theta,Z)}=1$$

In the multi-ellipsoid equation (1) shown above, the variable sign "X" indicates the x-coordinate on the horizontal x-axis, the variable sign "Y" indicates the y-coordinate on the vertical y-axis, the variable sign "Z" indicates the z-coordinate on an optical axis, the function "a(θ,Z)" is a length equation (2) of the semi-major axis, the function "b(θ,Z)" is a length equation (3) of the semi-minor axis. The length equation (2) of the semi-major axis is shown as following:

Equation (2):

$$a(\theta,Z)=a_A(\theta)+\left(\frac{Z_A-Z}{Z_A-Z_B}\right)^2[a_B(\theta)-a_A(\theta)]$$

The function "$a_A(\theta)$" specifies the first axis-length (one axis length of a ellipse on the latitudinal cross-sectional plane) and is a function of both the included angle (θ) and the latitudinal cross-sectional plane of the optical axis at the front side 2114 of the multi-axes reflecting surface 211, the function "$a_B(\theta)$" specifies the second axis-length (another axis length of the ellipse on the latitudinal cross-sectional plane) and is a function of both the included angle (θ) and the latitudinal cross-section plane of the optical axis at the rear side 2115 of the multi-axes reflecting surface 211, in which the function sign "a" is the length of the semi-major axis. The subscript letter "A" of the function sign "a" in the function "$a^A(\theta)$" indicates the front side 2114 has a larger cross-sectional ellipse than the rear side 2115. In addition, the subscript letter "B" of a function sign "a" in the function "$a_B(\theta)$" indicates the rear side 2115 has a smaller cross-sectional ellipse than the front side 2114. Moreover, the first axis-length angle function "$a_A(\theta)$" and second axis-length angle function "$a_B(\theta)$" are respectively described as following equations:

Equation (2-1):

$$a_A(\theta)=a_{A1}\cos^2\phi+a_{A2}\sin^2\phi$$

Equation (2-2):

$$a_B(\theta)=a_{B1}\cos^2\phi+a_{B2}\sin^2\phi$$

wherein $$\phi=\left(\frac{\theta-\theta_1}{\theta_2-\theta_1}\right)\frac{\pi}{2}$$

Where the subscript number "1" of the function and variable signs, such as "a", "θ", " Z", indicates an initial position on a multi-axes reflecting surface 211 of a multi-ellipsoid reflector 210, and the subscript number "2" of the function and variable signs, such as "a", "θ" indicates a final position on a reflecting multi-axes surface 211 of a multi-ellipsoid reflector 210. In addition, "sin" represents a trigonometric sine function; "cos" represents a trigonometric cosine function. The variable sign "ϕ" represents a normalizing angle 310, when the angle "$\theta=\theta_1$" then "ϕ=0", or when the angle "$\theta=\theta_2$" then "ϕ=π/2". Therefore, the normalizing angle "ϕ" 310 is able to correspond with any initial angel ($\theta_1$) and any final angle ($\theta_2$) at any reflecting zone of the multi-axes reflecting surface 211, in which "$0°\leqq\theta_1\leqq360°$" and "$\theta0°\leqq\theta_2\leqq360°$". In the first axis-length equation (2-1), the value of "$a_A$" is between the value of "$a_{A1}$" and "$a_{A2}$", besides, "$0\leqq\sin\theta\leqq1$" and "$0\leqq\cos\theta\leqq1$" such that "$0°\leqq\phi\leqq90°$" forming a normalizing angle "ϕ" 310.

In the second axis-length equation (2-2), the value of "$a_B$" is between the value of "$a_{B1}$" and "$a_{B2}$", "$0\leqq\sin\theta\leqq1$" and "$0\leqq\cos\theta\leqq1$" such that the normalizing angle 310 is "$0°\leqq\phi\leqq90°$".

The length equation (3) of the semi-minor axis in a multi-ellipsoid equation (1) is shown as following:

Equation (3):

$$\begin{aligned}b(\theta,Z)&=\sqrt{a^2(\theta,Z)-c^2(\theta,Z)}\\&=\sqrt{[a(\theta,Z)+c(\theta,Z)][a(\theta,Z)-c(\theta,Z)]}\\&=\sqrt{[a(\theta,Z)+c(\theta,Z)][2a(\theta,Z)-(a(\theta,Z)+c(\theta,Z))]}\end{aligned}$$

Where the function "c(θ,Z)" is a focus length, and the second focal points of the ellipses on the multi-axes reflecting surface 211 of the multi-ellipsoid reflector 210 are all focused on one focus position, which is also a focal point of the lens 230 (The focal point of the lens 230 is a third focal point of the projector-type vehicle headlamp system 200). In other words, the second focal points of the ellipses are located at one point, which overlaps the focal point of the lens 230. Thus, the function value of "a(θ,Z)+c(θ,Z)" is a definite value (or a fixed value) such that the length equation (3) of the semi-minor axis "b(θ,Z)" varies with the length equation (2) of the semi-major axis "a(θ,Z)" in an ellipsoid. Therefore, the length equations (2 & 3) of the semi-major and semi-minor axis are both the functions of the variables "θ" and "Z".

Figure 9:
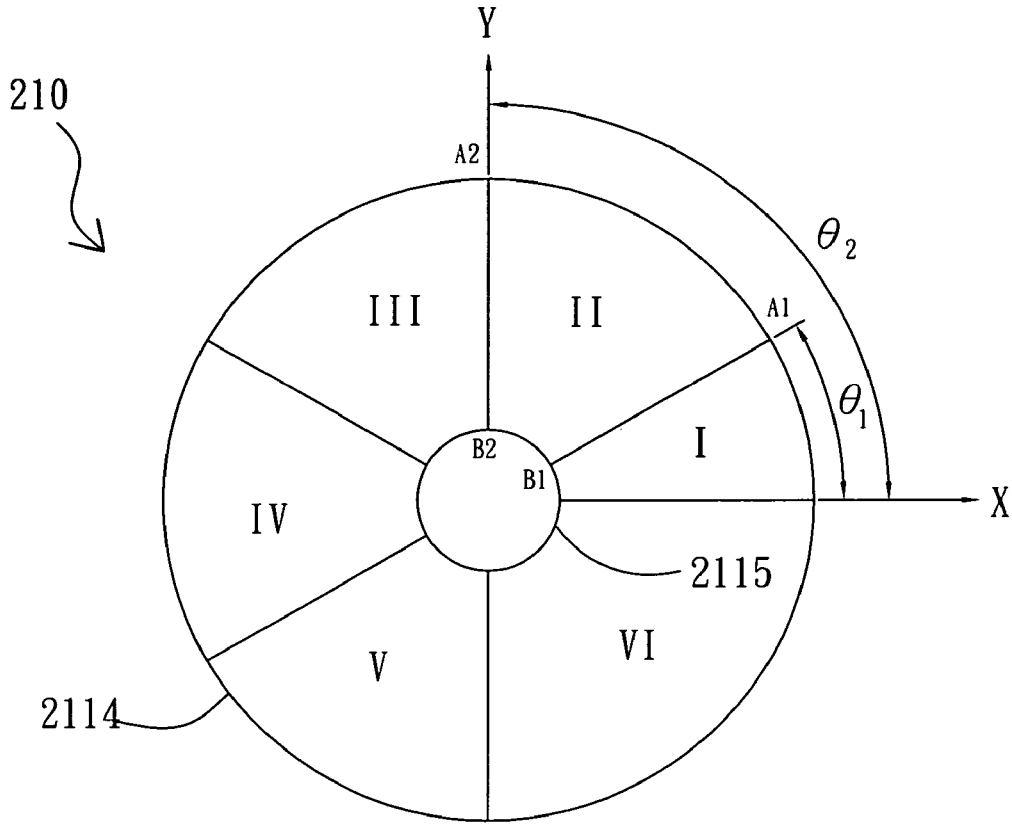
FIG. 9 shows six reflecting zones of a reflector on a projector-type vehicle headlamp system.

FIG. 9 shows six reflecting zones of a multi-axes reflecting surface 211 of a multi-ellipsoid reflector 210 in a projector-type vehicle headlamp system 100, which are reflecting zone I, II, III, IV, V, and reflecting zone VI. In reflecting zone II, for example, a subscript letter "A" indicates the position on the front side 2114 of a multi-axes reflecting surface 211, and a subscript letter "B" indicates the position on the rear side 2115 of the multi-axes reflecting surface 211. The subscript "1" indicates an initial point on reflecting zone II of a multi-axes reflecting surface 211 and subscript "2" indicates a final point on reflecting zone 20 μl of the multi-axes reflecting surface 211.

Figure 10:
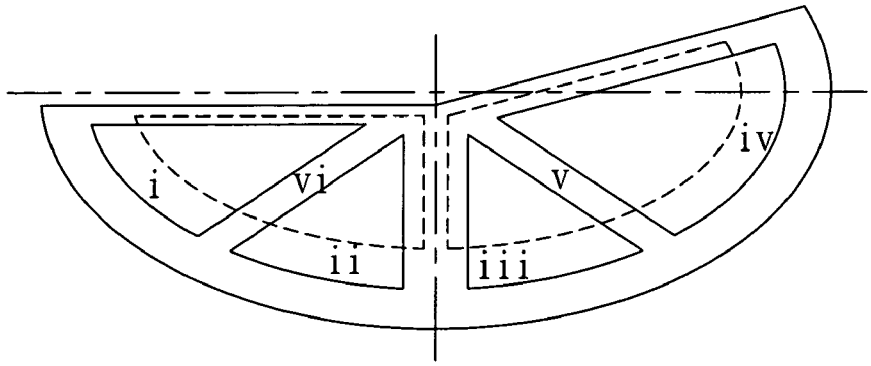
FIG. 10 shows an image of six lighting distribution zones formed by the light rays emitted from a light source via six reflecting zones of a reflecting surface for a projector-type headlamp system.

FIG. 9 and FIG. 10 respectively illustrate the reflecting zones (FIG. 9) and the lighting distribution zones (FIG. 10) where FIG. 10 shows an image of six lighting distribution zones formed by the light rays emitted from a light source via six reflecting zones of a multi-axes reflecting surface of a projector-type headlamp system. The lighting distributions include lighting distribution zone i, ii, iii, iv, v, and lighting distribution zone vi. The lighting distribution zone vi overlaps the lighting distribution zone i and ii, and the lighting distribution zone v overlaps the lighting distribution zone iii and iv. Hence, FIG. 10 shows an image of six lighting distribution zones formed by the light rays emitted from a light source 220 (a filament) via six reflecting zones of a multi-axes reflecting surface 211, where reflecting zone i, ii, iii, iv, v, and reflecting zone vi form respective orderly lighting distribution zones labeled lighting distribution zone i, ii, iii, iv, v, and lighting distribution zone vi accordingly.

Figure 11:
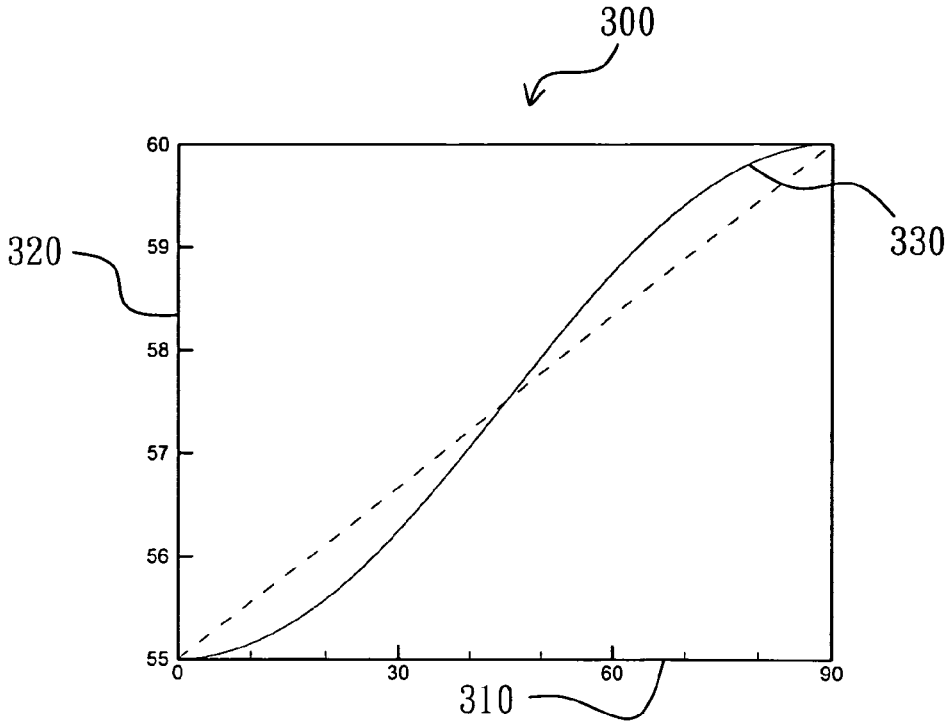
FIG. 11 shows a relationship diagram between the axis length and the normalizing angle.
Figure 12:
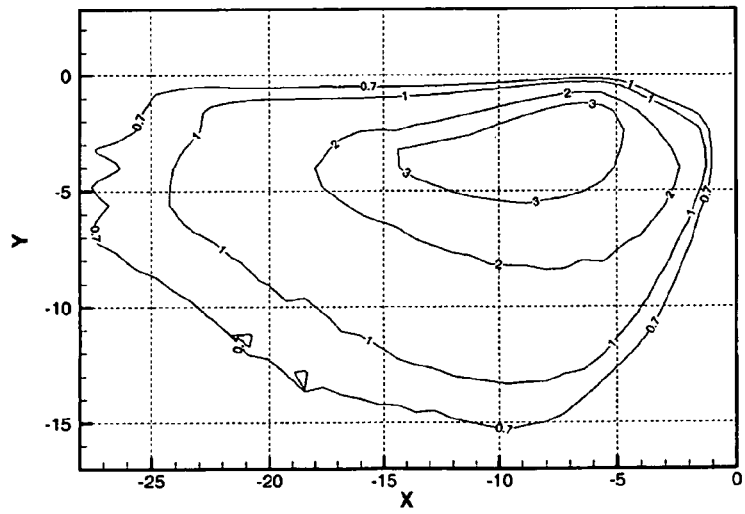
FIG. 12 illustrates a lighting distribution diagram in a preferred embodiment of the present invention.

FIG. 11 shows a variation curve 330 in the relationship diagram 300 that shows the relationship between the axis length 320 and the normalizing angle 310 on a multi-axes reflecting surface, where the normalizing angle 310 is on the horizontal coordinate axis (unit: degree), and axis length 320 is on the perpendicular coordinate axis (unit: millimeter). FIG. 12 illustrates a lighting distribution diagram for a preferred embodiment of the present invention, where the light rays emitted from a light source 220 via the reflecting zone vi on a multi-axes reflecting surface 211 form a lighting distribution image. The axis length 320 varies with the normalizing angle 310 (please see FIG. 11 again).

Figure 13:
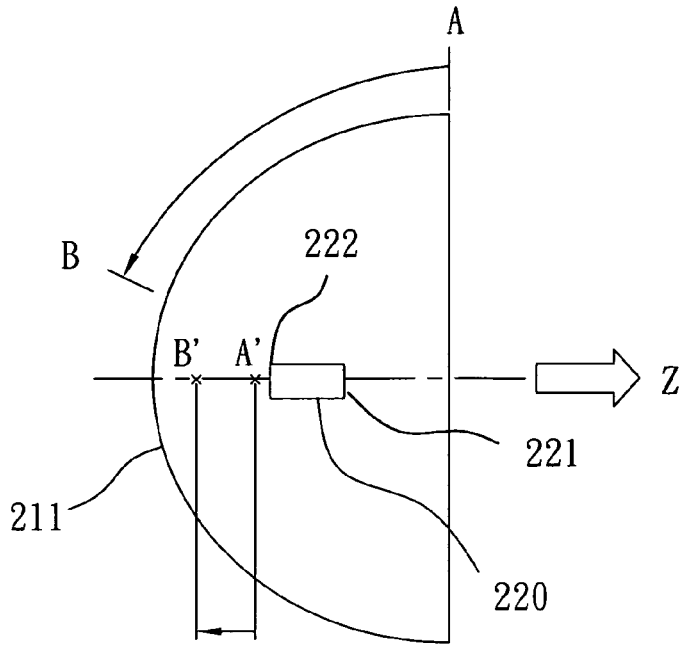
FIG. 13 illustrates a first focal point of a reflecting surface of a reflector has many different positions in the direction of an optical axis

Please refer to FIG. 9 and FIG. 12 again and FIG. 13. In the provision of an embodiment of the present invention, FIG. 13 illustrates a first focal point of a multi-axes reflecting surface 211 of a multi-ellipsoid reflector 210 has many different positions on the optical axis where a filament 220 (a light source) has a first-end 221 and a second-end 222. The position of the first focal point of a multi-axes reflecting surface 211 is changed from the first-end 221 to the second-end 222 on the optical axis. In other words, the position of the first focal point of a multi-axes reflecting surface 211 is positioned at the first-end 221 such that $\theta=\theta_1=270°$ ($\phi=0°$), and/or the position of the first focal point of the multi-axes reflecting surface 211 is positioned at the second-end 222 such that $\theta=\theta_1=360°$ ($\phi=90°$). Therefore, the image of the lighting distributions of the light rays emitted from the filament 220 can be adjusted below the Y=0 horizontal line (illustrated in FIG. 12 as the line "Y=0") and produces a flat, broad lighting distribution image of the multi-axes reflecting surface 211. Hence, it is readily known by referring to the aforementioned embodiment that the present invention produces an extended light distribution image of a light source 220 via the multi-axes reflecting surface 211 with no glare lights. Furthermore, the multi-axes reflecting surface 211 is able to control the light distribution image by changing the position of the first focal points of each ellipsoid of the multi-axes reflecting surface 211.

Figure 2:
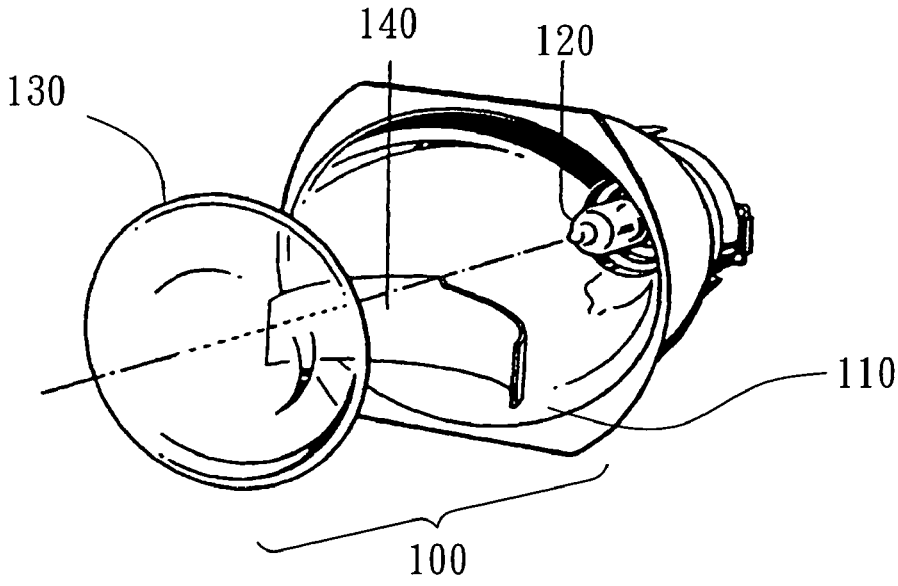
Fig. 2 (Prior art)
FIG. 2-FIG. 4 illustrate a conventional PES vehicle headlamp system.
Figure 3:
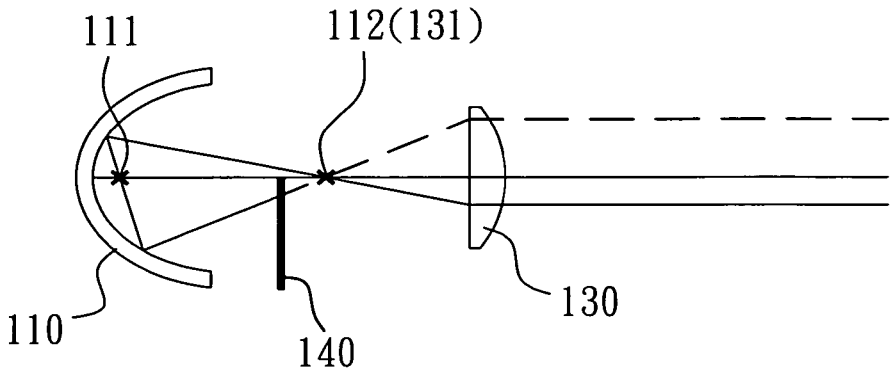
Fig. 3 (Prior art)
Figure 4:
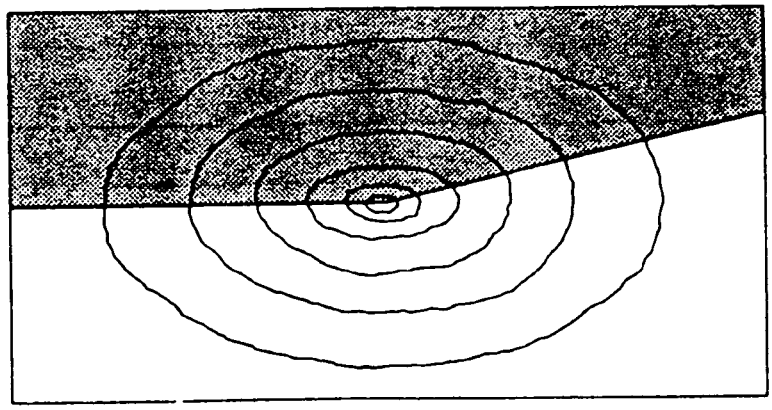
Fig. 4 (Prior art)

Please compare FIG. 2 with FIG. 13. In FIG. 2 a filament 120 (a light source) of a conventional projector-type vehicle headlamp system 100 is usually not a point and has a required length but a focal point position of the reflecting surface of the ellipsoidal reflector 110 is usually fixed at one point at one end of the light source 120. Therefore, the lighting distribution image size of a conventional projector-type vehicle headlamp system 100 along an optical axis is limited by having one fixed position for the first focal point and a light source 120 that has a length. The image size and the illumination of the light source 120 vary with changes in the position of the light source 120 along the optical axis. Consequently, the reflecting surface of the ellipsoidal reflector 110 forms a light distribution image with different sizes. The image sizes increase when the position on the reflecting surface approaches the light source 120. Moreover, the illumination is smaller when the image size is larger. But the dispositions of the light distribution images are determined by the position of the first focal point 111 of the ellipsoidal reflector 110 and there is only one fixed position for the focal point 111 of the ellipsoidal reflector 110 along the optical axis. Accordingly, the range of the lighting distribution of the ellipsoidal reflector 110 is restricted.

FIG. 13 shows the ability to effectively control the structure of the light distribution images with changeable first focal points of the multi-axes reflecting surface 211 of a multi-ellipsoid reflector 210. When the position of the multi-axes reflecting surface 211 of the multi-ellipsoid reflector 210 is changed from front point "A" to rear point "B" in which the position of the first focal point is also changed from point "A" to point "B" on an optical axis, axes length of the ellipsoids of the multi-axes reflecting surface 211 also change. Moreover, the position of the first focal point of the multi-axes reflecting surface 211 is determined with a multi-ellipsoid equation (1) with various axes equations and the focal point is therefore also able to change with the length of the axis. Consequently, the images of the lighting distributions of the present invention are effectively controlled and overlapped to increase total illuminating performance and quality.

Figure 14:
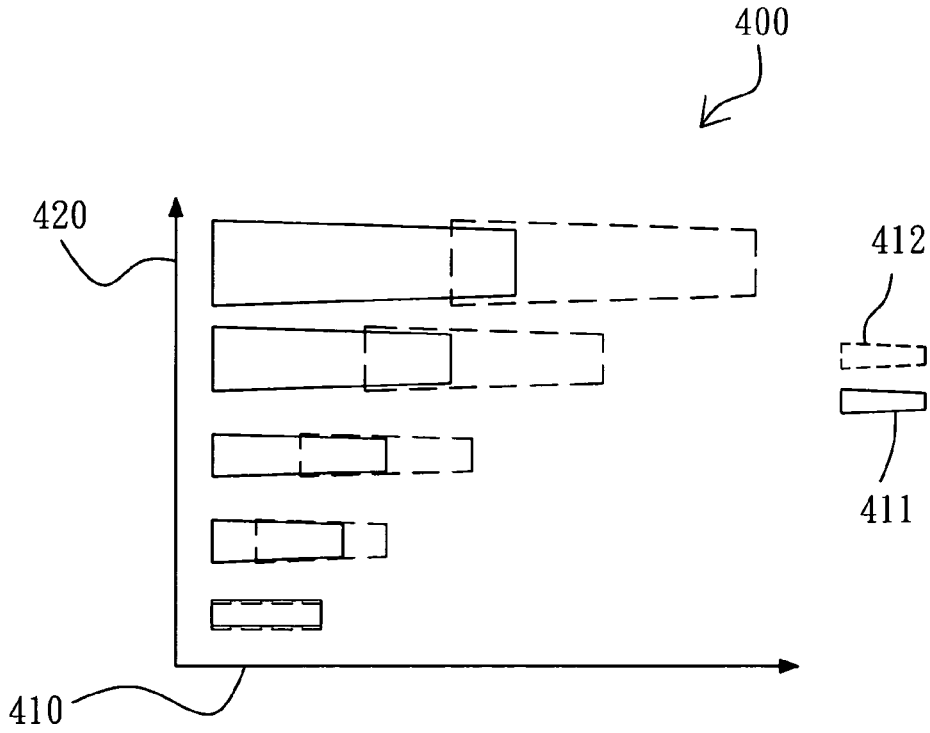
FIG. 14 shows the relationship diagram for the image distribution outlines (an x-axis) and the image positions on the optical axis (a y-axis).

Please refer to FIG. 2 and FIG. 13 again and FIG. 14 in which FIG. 14 shows the image relationship diagram 400 for the image distribution outlines 410 and the image positions 420 on the optical axis for the first image performance 411 of a conventional PES (projector-type) vehicle headlamp system 100 and the second image performance 412 of the invention of a projector-type vehicle headlamp system 200 where a filament is used as a light source 120/220. The image distribution outlines 410 show the size of the light distribution images for both the PES vehicle headlamp system 100 and the projector-type vehicle headlamp system 200 of the present invention. The image positions 420 on an optical axis both show the distance between the reflecting surface of the reflector and the light source 120 for the PES vehicle headlamp system 100 and the invention of the projector-type vehicle headlamp system 200. The first image formed 411 show the light distribution image of a ellipsoidal reflector 110 in a conventional PES vehicle headlamp system 100. The second image formed 412 shows the light distribution image of a multi-ellipsoid reflector 210 in a projector-type vehicle headlamp system 200 of the present invention. The dispositions of the first image performance 411 of the ellipsoidal reflector 110 are obviously limited by inefficiently overlapping the light distribution images. That is because the reflecting surface of the ellipsoidal reflector 110 is designed with a general ellipsoid equation. The dispositions of the second image performance 412 of the multi-axes reflector 210 (a multi-ellipsoid reflector) is designed by a multi-ellipsoid equation (1) where the axis length varies with the position on an optical axis and allows the multi-axes reflector 210 to have many different first focal points on the optical axis at the same time. In other words, the multi-ellipsoid reflector 210 is able to control the performance of the light distribution images of the light rays emitted from the light source 220 via the multi-ellipsoid reflector 210.

Please refer to FIG. 14 again, it is obvious that the width of the overlapped light distributions on the light distribution image of the projector-type vehicle headlamp system 200 is wider than the conventional projector-type (PES) vehicle headlamp system 100, meanwhile, the illuminating quality of the images of the lighting distributions is still maintained. To sum up, the present invention of the projector-type vehicle headlamp system 200 controls the lighting distributions more effectively than the conventional projector-type vehicle headlamp 00.

Figure 5A:
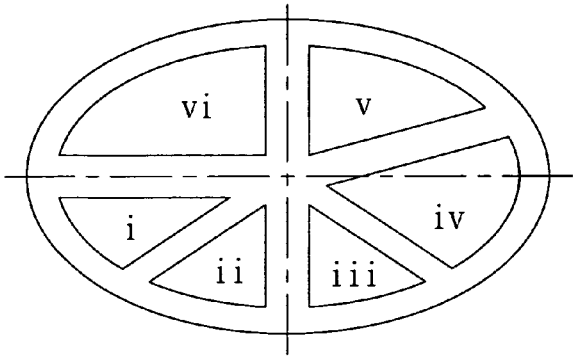
Fig. 5A (Prior art)
FIG. 5A shows the image of the lighting distribution zones of a light pattern for a conventional PES vehicle headlamp system without using a shade
Figure 5B:
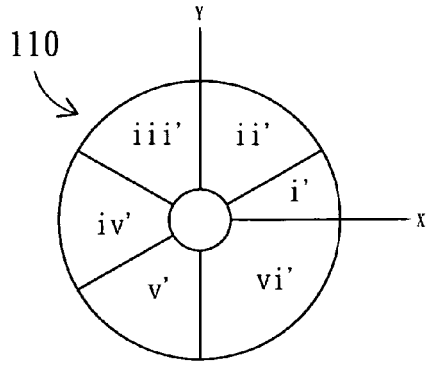
Fig. 5B (Prior art)
FIG. 5B shows the six reflecting zones of a conventional reflector.
Figure 6:
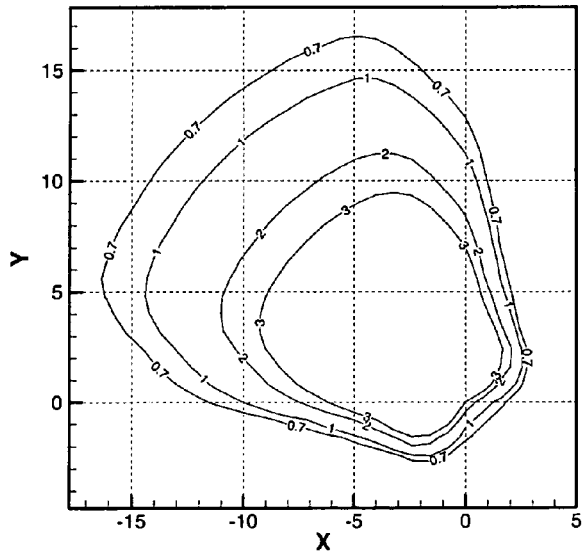
Fig. 6 (Prior art)
FIG. 6 shows the lighting distribution of the lighting distribution zone vi of a conventional PES vehicle headlamp system that does not use a shade.
Figure 15:
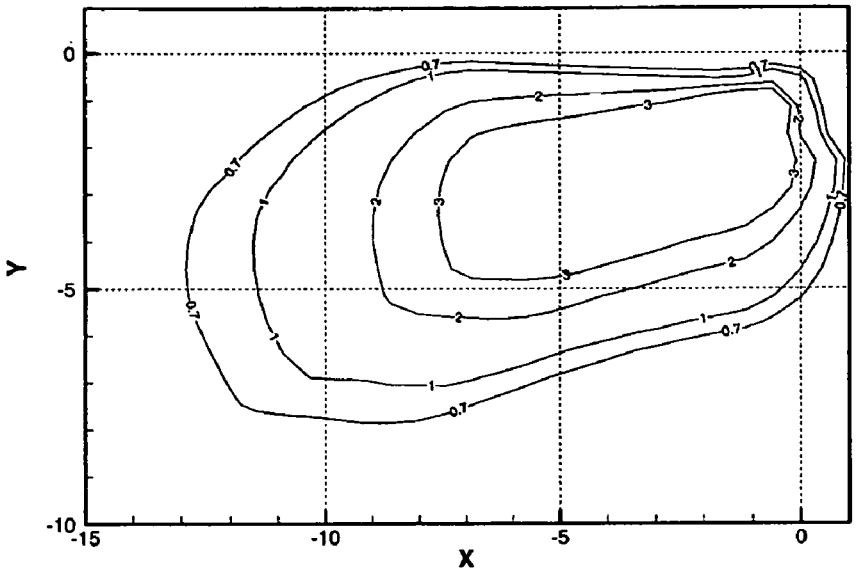
Fig. 15 (Prior art)
FIG. 15 is an image of lighting distribution ranges of reflecting zone I for a reflecting surface of a conventional PES vehicle headlamp system.
Figure 16:
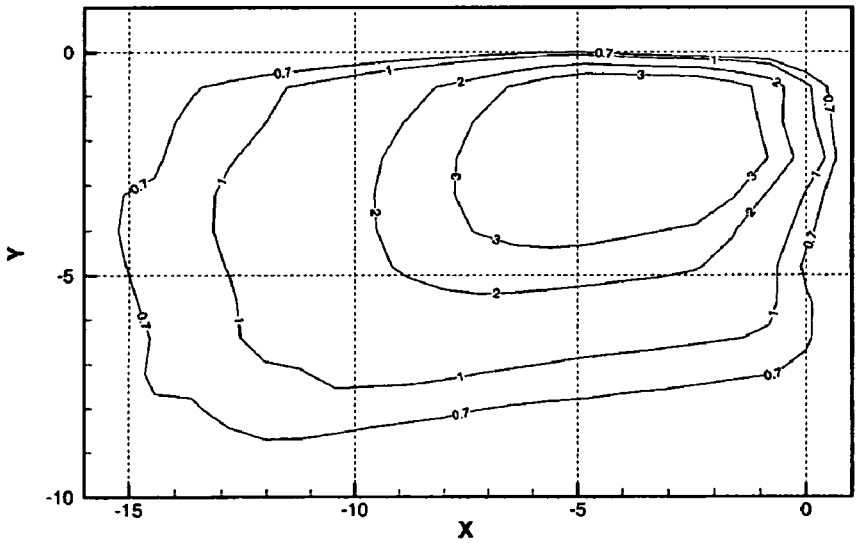
FIG. 16 is an image of lighting distribution ranges of reflecting zone I for a multi-axes reflecting surface of a projector-type vehicle headlamp system.

In one embodiment of the present invention, please refer to FIG. 5, FIG. 15 and FIG. 16 together, where the FIG. 15 and FIG. 16 respectively illustrate the image ranges of the lighting distributions of reflecting zone "I" for a reflecting surface of a conventional PES vehicle headlamp system 100 and a multi-axes reflecting surface 211 of a projector-type vehicle headlamp system 200. After comparing FIG. 15 and FIG. 16, it is easily to see that the width of the lighting distribution of the multi-axes reflecting surface 211 is over fifteen degrees, and the image width of the reflecting surface of a conventional ellipsoidal reflector 110 is within thirteen degrees. Moreover, by using the same illumination range of the brightest area in the reflecting zone I for the ellipsoidal reflector 110 and the multi-ellipsoid reflector 210, the illuminating range of the multi-ellipsoid reflector 210 is larger than the illuminating range of the conventional ellipsoidal reflector 110.

Please refer to FIG. 9 and FIG. 10 again. After concluding the aforementioned embodiments of the present invention for the reflecting zones of the six reflecting surfaces and six lighting distributions, the reflecting zone "I" and "VI" are both projecting the light rays emitted from the light source 220 to the same area, that is, the lighting distribution zone "i" and "vi" at least partially overlap each other. It is seen that the projector-type vehicle headlamp system 200 greatly improves the gradient of the illuminating performance and increases the illumination utility rate.

Please refer to FIG. 9 and FIG. 10 again. In one embodiment of the present invention, the six reflecting zones are formed by a free-curved reflecting surface (a multi-axes reflecting surface 211 of the present invention). In order to form a horizontal cut-off line between reflecting zone "I" and zone "VI" and a tilting-up cut-off line between reflecting zone "IV" and zone "V", the tilting-up cut-off line must have a fifteen degree included angle with the horizontal cut-off line. This lowers and widens the light distribution image. Thus, in the multi-ellipsoid equation (1) forming a multi-axes reflecting surface 211 of the present invention, the function $a_A(\theta)$ (a first axis-length equation (2-1) of a latitudinal cross-section plane of an optical axis) is not equal to the function $a_B(\theta)$(a second axis-length equation (2-2) of latitudinal cross-section plane of an optical axis) so that the images of the lighting distribution zones may form a horizontal cut-off line and a fifteen-degree tilting cut-off line at the same time. This will also increase the illumination utility rate of the light source 220.

In another embodiment of the present invention, in the multi-ellipsoid equation (1) that is used to design and form a multi-axes reflecting surface 211, let the function $a_A(\theta)$ equals the function $a_B(\theta)$ such that the lighting distribution zones forms a concentrated light distribution image that increases the total illuminating performance and quality. Therefore, to perform the aforementioned objects are carried out with a multi-axis reflecting surface 211 of a multi-ellipsoid reflector 210 formed with a multi-ellipsoid equation (1) in a projector-type vehicle headlamp of the present invention.

Figure 17:
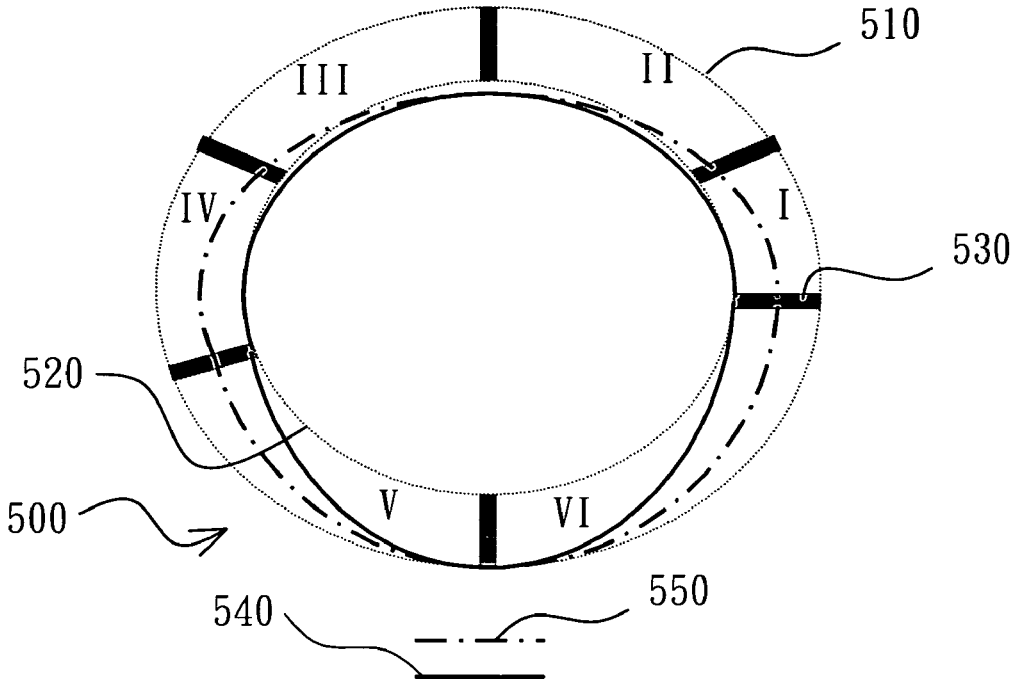
FIG. 17 illustrates the distributions of the first focal point on the six reflecting zones of the multi-axes reflecting surface.

Please refer to FIG. 9, FIG. 13 and FIG. 17 together for an embodiment of the present invention, where FIG. 17 illustrates the distributions diagram 500 of the first focal points on the six reflecting zones for a front side 2114 and a rear side 2115 of the multi-axes reflecting surface 211 and for a first-end 221 and a second-end 222 of a filament 220 (a light source with a length) respectively. A first distribution 510 is a distribution for the first-end 221 of a filament 220 via six reflecting zones on a multi-axes reflecting surface 211. A second distribution 520 is a distribution of for the second-end 222 of the filament 220 via six reflecting zones on the multi-axes reflecting surface 211. A third distribution 530 is a distribution area of a filament 220 via six reflecting surface 211 on the multi-axes reflecting surface 211. A forth distribution 540 and a fifth distribution 550 are both the first focal points' continuous distributions for a front side 2114 and a rear side 2115 of the multi-axes reflecting surface 211. The multi-axes reflecting surface 211 of the multi-ellipsoid reflector 210 is designed and formed by the multi-ellipsoid equation (1), which is a continuous equation for the variation of the axes lengths. Thus, The multi-axes reflecting surface 211 has a free-curved surface with no step.

Figure 18:
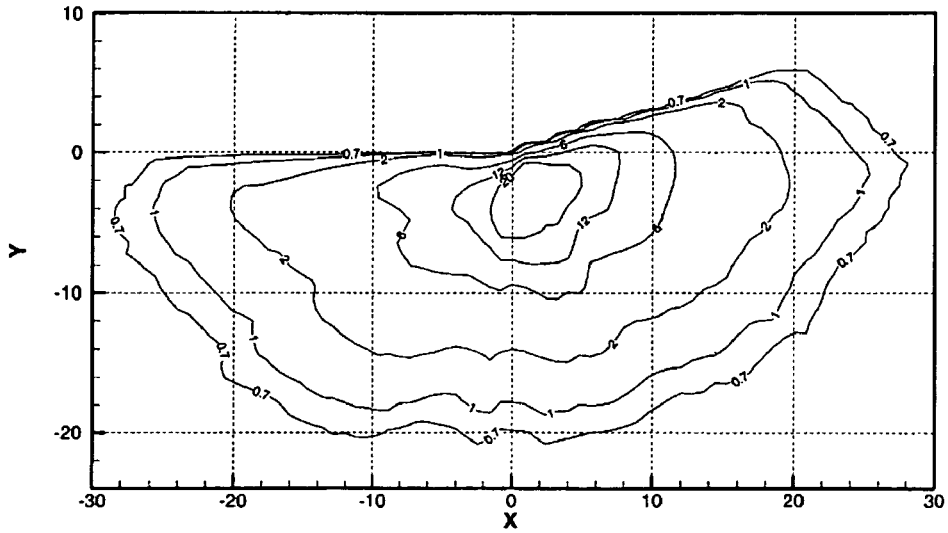
FIG. 18 illustrates the complete performance of the six lighting distributions for one preferred embodiment of the present invention and the effective illuminating image range of a projector-type vehicle headlamp system.

FIG. 18 shows one preferred embodiment of the present invention and illustrates the performance of the six lighting distributions and the effective illuminating image range of a projector-type vehicle headlamp system 200. The projector-type vehicle headlamp system 200 comprises a multi-ellipsoid reflector 210, a light source 220, and a lens 230. The light source 220 is a "H1 bulb" type filament, which is an automotive halogen bulb. The whole lighting distribution of the projector-type vehicle headlamp system 200 reaches over twenty-eight degrees to the left side and the right side and the cut-off line is definitely marked. Moreover, the illumination of the brightest area is over 20 lux. Please refer to FIG. 18 again, and table 1, where table 1 is shown as below and lists the required illuminating values of the low beam in the ECE regulations for a vehicle lamp and compares them to the illuminating values of a projector-type vehicle headlamp of the present invention.

TABLE 1

| Testing points | | Illuminating values of a projector-type vehicle headlamp system of the present invention (Lux) | ECE required illuminating values (Lux) |
|---|---|---|---|
| 1 | Point B50L | 0.27 | ≦0.4 |
| 2 | Point 75R | 16.3 | ≧12 |
| 3 | Point 75L | 3.5 | ≦12 |
| 4 | Point 50L | 5.0 | ≦15 |
| 5 | Point 50R | 21.7 | ≧12 |
| 6 | Point 50V | 9.3 | ≧6 |
| 7 | Point 25L | 5.4 | ≧2 |
| 8 | Point 25R | 9.1 | ≧2 |
| Any point in zone III | | <0.7 | ≦0.7 |
| Any point in zone IV | | >3 | ≧3 |
| Any point in zone I | | <2 × 30.13 | ≦2 × ($E_{50R}$) |

It be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A projector-type vehicle headlamp system, comprising:

a light source, emitting the light rays;

a multi-ellipsoid reflector, reflecting the light rays emitted from the light source and the multi-ellipsoid reflector is designed with a multi-ellipsoid equation (1);

a lens, refracting the light rays emitted from the light source;

Equation (1):

$$\frac{X^2+Y^2}{b^2(\theta, Z)}+\frac{(Z-a(\theta, z)^2)}{a^2(\theta, Z)}=1$$

wherein a variable sign "X" indicates a x-coordinate on the x-axis as a horizontal axis: a variable sign "Y" indicates a y-coordinate on the y-axis as a vertical axis; a variable sign "Z" indicates a z-coordinate on the z-axis as an optical axis; a function "a (θ,Z)" is a length equation (2) of the semi-major axis and a function "b(θ,Z)" is a length equation (3) of the semi-minor axis.

2. The projector-type vehicle headlamp system of claim 1, wherein the length equation (2) of the semi-major axis is shown as below:

Equation (2):

$$a(\theta, Z)=a_A(\theta)+\left(\frac{Z_A-Z}{Z_A-Z_B}\right)^2[a_B(\theta)-a_A(\theta)]$$

wherein "$a_A(\theta)$" is a first axis-length equation (2-1), which is a function of the latitudinal cross-section plane of an optical axis in the multi-ellipsoid reflector; "$a_B(\theta)$" is a second axis-length equation (2-2), which is a function of the latitudinal cross-section plane of an optical axis in the multi-ellipsoid reflector; a subscript letter "A" of the function sign "a" in function "$a_A(\theta)$" indicates a front side with a larger cross-sectional ellipse; a subscript letter "B" of a function sign "a" in function "$a_B(\theta)$" indicates the rear side with a smaller cross-sectional ellipse.

3. The projector-type vehicle headlamp system of claim 2, wherein the first axis-length equation (2-1) and the second axis-length equation (2-2) are respectively shown as below:

$$a_A(\theta)=a_{A1}\cos^2\phi+a_{A2}\sin^2\phi \quad \text{Equation (2-1):}$$

$$a_B(\theta)=a_{B1}\cos^2\phi+a_{B2}\sin^2\phi \quad \text{Equation (2-2):}$$

wherein a subscript number "1" in function sign "a" indicates an initial position on the multi-axes reflecting surface, and a subscript number "2" in "a" indicates a final position on the reflecting multi-axes surface; a variable sign "ϕ" indicates a normalizing angle.

4. The projector-type vehicle headlamp system of claim 3, wherein the normalizing angle "ϕ" has a degree of in the range from zero to ninety degree ($0° \leqq \phi \leqq 90°$).

5. The projector-type vehicle headlamp system of claim 1, wherein the length equation (3) of the semi-minor axis is shown as below:

Equation (3):

$$\begin{aligned} b(\theta, Z) &= \sqrt{a^2(\theta, Z)-c^2(\theta, Z)} \\ &= \sqrt{[a(\theta, Z)+c(\theta, Z)][a(\theta, Z)-c(\theta, Z)]} \\ &= \sqrt{[a(\theta, Z)+c(\theta, Z)][2a(\theta, Z)-(a(\theta, Z)+c(\theta, Z))]} \end{aligned}$$

wherein a function "c (θ,Z) is a focus length.

6. The projector-type vehicle headlamp system of claim 1, wherein the multi-ellipsoid reflector further comprising a multi-axes reflecting surface, which is designed with the multi-ellipsoid equation (1).

7. The projector-type vehicle headlamp system of claim 1, wherein the multi-ellipsoid equation (1) has at least a length equation (2) of the semi-major axis and at least a length equation (3) of the semi-minor axis.

* * * * *